US005881920A

United States Patent [19]

Seager et al.

[11] Patent Number: 5,881,920

[45] Date of Patent: Mar. 16, 1999

[54] PRODUCT DISPENSER HAVING SEPARABLE REFILL CARTRIDGE

[75] Inventors: Richard H. Seager, Mystic, Conn.; Peter Piscopo, Medford; Alfred J. Astoreca, Annandale, both of N.J.

[73] Assignee: The Plastek Group, Erie, Pa.

[21] Appl. No.: 851,770

[22] Filed: May 6, 1997

[51] Int. Cl.[6] ..... B67D 5/62

[52] U.S. Cl. ..... 222/137; 222/145.3; 222/327

[58] Field of Search ..... 222/145.3, 327, 222/137, 541.4

[56] References Cited

U.S. PATENT DOCUMENTS

| | | | |
|---|---|---|---|
| 315,496 | 3/1885 | Pettengill . | |
| 3,029,987 | 4/1962 | Gronemeyer | 222/541.4 |
| 3,767,085 | 10/1973 | Cannon et al. | 222/327 X |
| 4,687,663 | 8/1987 | Schaeffer . | |
| 4,964,539 | 10/1990 | Mueller . | |
| 5,020,694 | 6/1991 | Pettengill . | |
| 5,038,963 | 8/1991 | Pettengill et al. . | |
| 5,059,417 | 10/1991 | Williams et al. . | |
| 5,186,926 | 2/1993 | Williams et al. . | |
| 5,289,949 | 3/1994 | Gentile . | |
| 5,335,827 | 8/1994 | Gentile | 222/137 |
| 5,372,803 | 12/1994 | Williams et al. . | |

*Primary Examiner*—Gregory L. Huson
*Attorney, Agent, or Firm*—Bachman & Lapointe, P.C.

[57] ABSTRACT

A product dispenser includes a cartridge containing a product; a housing having a sidewall defining an interior space for receiving the cartridge; an access cutout formed in the sidewall for installing and removing the cartridge in the interior space; and a ram and plunger structure associated with the housing for dispensing the product from the cartridge.

24 Claims, 3 Drawing Sheets

PRODUCT DISPENSER HAVING SEPARABLE REFILL CARTRIDGE

BACKGROUND OF THE INVENTION

The invention relates to a product dispenser and, more specifically, to a dispenser having a separable refill cartridge.

A number of products and containers are on the market in connection with products, specifically dental preparations, wherein a combination of two substances or ingredients are provided. For example, U.S. Pat. No. 4,687,663 is drawn to an article for storage and delivery of baking soda and peroxide preparations. As pointed out in this patent, hydrogen peroxide and sodium bicarbonate may not normally be premixed, as they immediately react and are thereby rendered ineffective for subsequent use. The '663 patent, as well as U.S. Pat. Nos. 4,964,539, D315,496, 5,020,694, 5,038,963 and 5,289,949 are drawn to dispensing containers addressing the problem of keeping sodium bicarbonate and hydrogen peroxide separate until use.

Containers such as those described in U.S. Pat. No. 5,289,949 mentioned above include a base portion and a housing/cartridge structure which slidably moves over the base portion. The product is contained in two cylinders which are an integral portion of the upper housing structure. When product from the cylinders is exhausted, the entire upper portion of the package must be discarded and replaced, leaving only the base as a reusable element.

The container of the above-mentioned U.S. Pat. No. 5,289,949 and others are successful at providing product in a form wherein the hydrogen peroxide and sodium bicarbonate are maintained in separate sections of a container. However, consumers recognize the waste in discarding the entire upper housing/cartridge structure, and the need remains for a solution to this problem.

It is therefore the primary object of the present invention to provide a product dispenser having a readily interchangeable refill cartridge wherein the entire housing is reusable.

It is a further object of the present invention to provide a product dispenser wherein removal and installation of replacement cartridges is readily accomplished.

It is still another object of the present invention to provide a product dispenser having a separable refill cartridge wherein product portions or components are readily provided through a product outlet or nozzle.

Other objects and advantages will appear hereinbelow.

SUMMARY OF THE INVENTION

In accordance with the present invention, the foregoing objects and advantages are readily attained.

According to the invention, a product dispenser is provided, which product dispenser comprising a cartridge containing a product; a housing having a sidewall defining an interior space for receiving said cartridge; access means formed in said sidewall for installing and removing said cartridge in said interior space; and means associated with said housing for dispensing said product from said cartridge.

In further accordance with the invention, a product dispenser is provided which comprises a cartridge containing a product; a housing having a sidewall defining an interior space for removably receiving said cartridge; said cartridge having a wall structure defining a plurality of discrete product spaces, and an outlet communicated with said plurality of product spaces for dispensing said product, said outlet being connected to said cartridge and extending from said housing when said cartridge is in said interior space; and means associated with the housing for dispensing said product from said cartridge through said outlet.

Still further in accordance with the invention, a cartridge for use in a product dispenser in accordance with the invention is provided, which cartridge comprises a cartridge wall structure defining a plurality of discrete product spaces each containing product; an outlet extending from said cartridge and communicated with each of said plurality of discrete product spaces; and a piston member slidably positioned in each of said plurality of discrete product spaces for driving product from said discrete product spaces out of said outlet.

BRIEF DESCRIPTION OF THE DRAWINGS

A detailed description of the preferred embodiments of the present invention follows, with reference to the attached drawings, wherein.

DETAILED DESCRIPTION

The invention relates to a product dispenser advantageously having a separable refill cartridge wherein the entire housing is reusable, and only the product cartridge is removed, disposed of, and replaced with a new refill cartridge.

Figure 1:
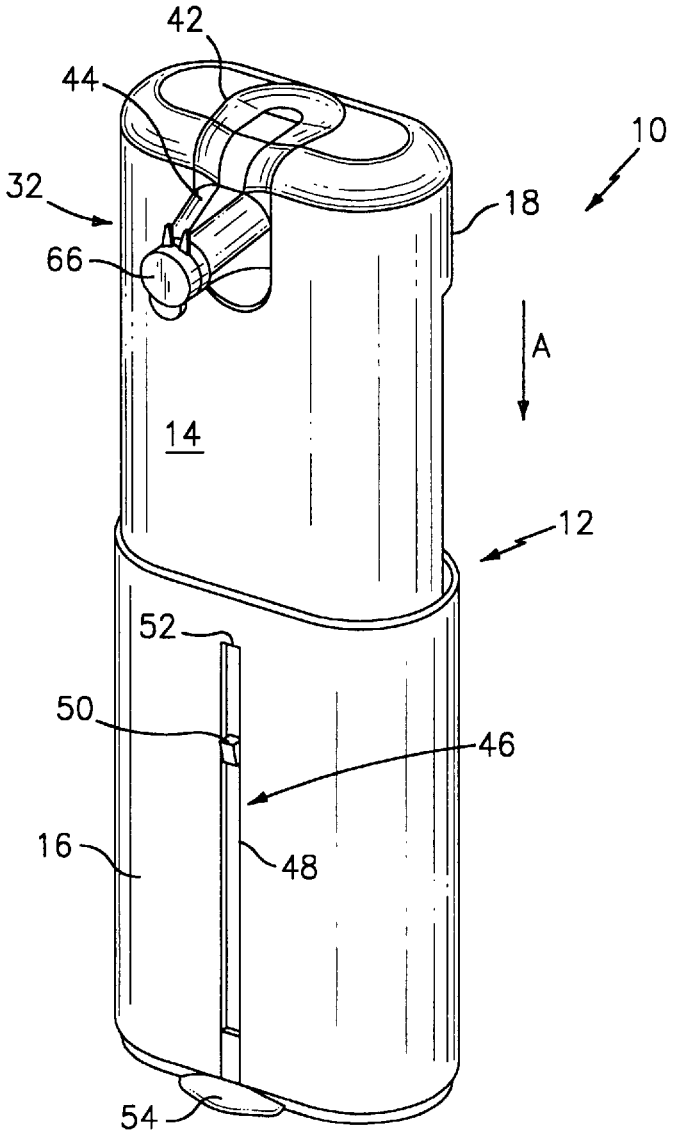
FIG. 1 is a perspective view of a product dispenser in accordance with the present invention.

FIG. 1 shows a perspective view of a product dispenser in accordance with the invention, which will generally be referred to in the drawings by reference numeral 10. According to the invention, dispenser 10 has a housing 12 preferably provided having an upper housing portion 14 and a lower housing portion 16 which are movably mounted together so that upper housing portion 14 can be depressed relative to lower housing portion 16 so as to dispense product as will be further discussed below.

Upper housing portion 14 preferably has a side wall 18 defining an interior space 20 for receiving a cartridge 22, which cartridge 22 contains product to be dispensed. Upper housing portion 14 preferably has sidewall 18 in the form of a substantially elongate oval-shaped sleeve, as shown, having a generally closed top and a generally open bottom.

Figure 2:
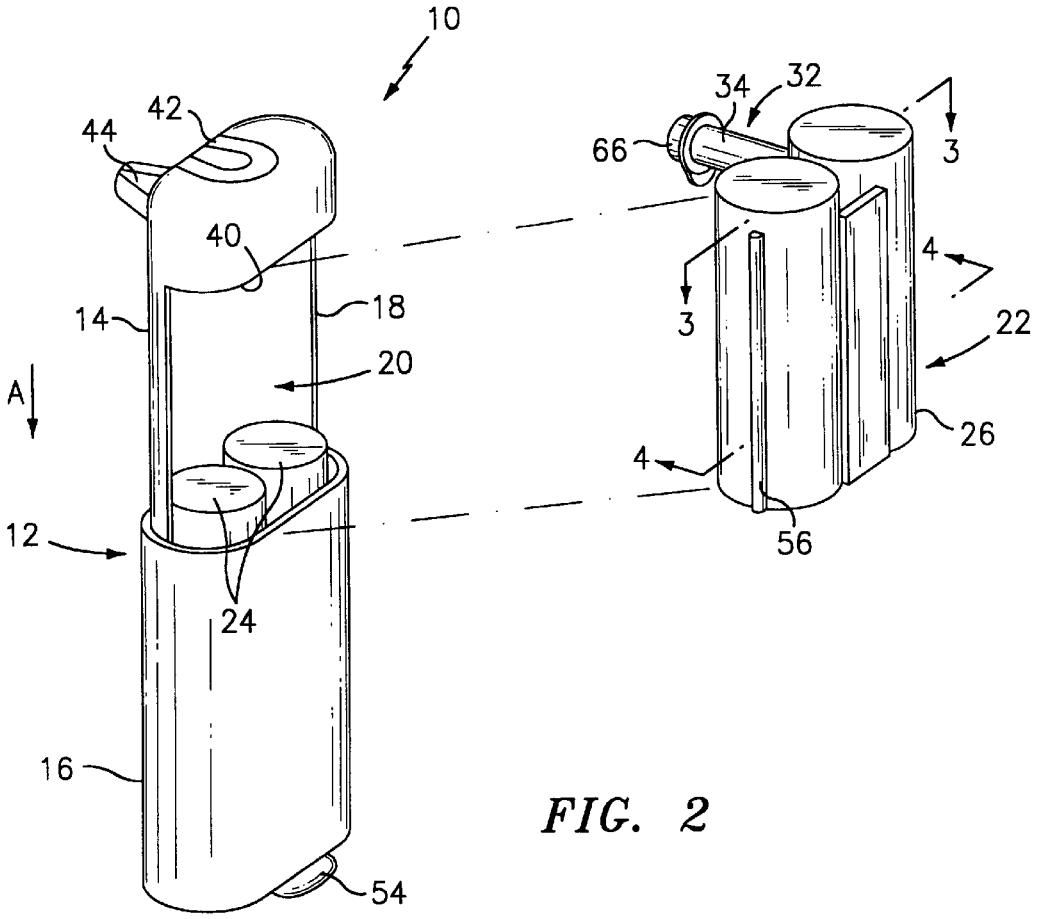
FIG. 2 is a rear perspective view of a preferred embodiment of the present invention showing a refill cartridge.

Lower housing portion 16 preferably also includes a side wall or sleeve portion sized to slidably receive upper housing portion 14, for example with upper housing portion 14 within lower housing portion 16 as shown in FIG. 1. Of course, the reverse of this configuration could also be provided. Referring also to FIG. 2, lower housing portion 16 preferably houses a ram structure 24 which interacts with cartridge 22 during depression of upper housing portion 14 relative to lower housing portion 16 so as to dispense product out of cartridge 22 as desired.

Figure 4:
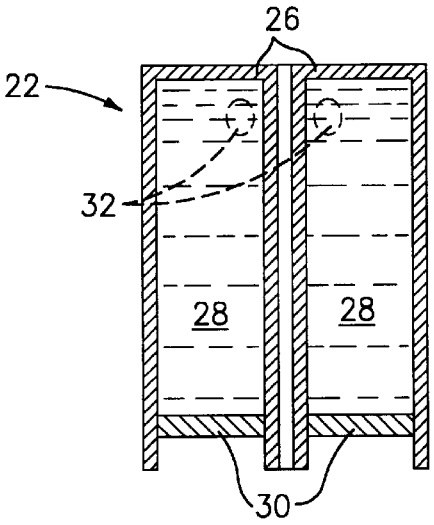
FIG. 4 is a sectional view taken along the lines 4—4 of FIG. 2.
Figure 3:
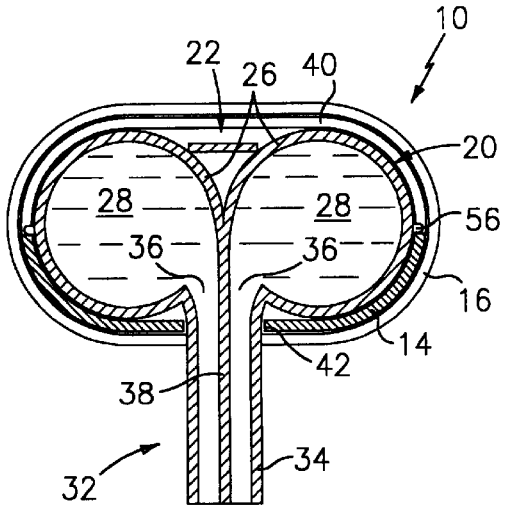
FIG. 3 is a sectional view taken along the line 3—3 of FIG. 2.

Cartridge 22 preferably has a wall structure 26 defining first and second chambers 28 (FIGS. 3, 4) for containing separate portions or components of product to be dispensed therefrom. As shown in FIG. 4, wall structure 26 defines chambers 28 substantially discretely from one another such that a product portion or component in one chamber 28 is not exposed to the product or component in the other chamber 28. This is advantageous for use, for example, in dispensing toothpaste or dentifrice components such as hydrogen peroxide and sodium bicarbonate, which are advantageous when combined but which cannot be mixed until they are to be used. A plunger 30 is preferably provided within each chamber 28 for driving product out of chamber 28 when desired. In this regard, cartridge 22 has an outlet structure 32, preferably in the form of a nozzle 34 communicated with an outlet 36 from each chamber 28. As shown in FIG. 3, suitable divider structure 38 may be provided within nozzle 34 so as to insure that components from chambers 28 are maintained separate and discrete until they are to be used. Structure 38 preferably extends to the end of nozzle 34 as shown.

In the embodiment of FIGS. 1–4, nozzle 34 is preferably provided as an integral portion of or otherwise affixed to cartridge 22 such that each cartridge 22 has a fresh nozzle 34 or outlet structure, thereby avoiding excessive product buildup and the like from extended use of a single nozzle.

Returning to FIG. 2, ram structure 24 is preferably provided and sized sufficiently so as to extend upwardly into chambers 28 and engage plungers 30 so that movement of upper housing portion 14 relative to lower housing portion 16 moves cartridge 22 relative to ram structure 24, thereby upwardly displacing plungers 30 within chambers 28 and dispensing product from outlets 36 as desired.

Still referring to FIG. 2, and as set forth above, upper housing portion 14 preferably includes side wall 18 defining interior space 20 for receiving cartridge 22 as indicated in the drawing. In accordance with the invention, and advantageously, side wall 18 is provided with a cutout 40 for providing access to interior space 20, advantageously while housing portions 14, 16 are assembled together. The removal of a spent cartridge and installation of a new cartridge is thereby readily facilitated by allowing access to interior space 20 through cutout 40 in side wall 18. Cutout 40 allows cartridge 22 to be interchanged without disassembling upper housing portion 14 from lower housing portion 16, thereby simplifying use by a consumer.

Referring back to FIG. 1, upper housing portion 14 is preferably provided with an additional cutout 42 for receiving nozzle 34 of cartridge 22 so as to allow nozzle 34 to extend from housing 12 for ease in use of product dispensed therefrom. As shown, housing 12 may be provided with a shroud structure 44 for at least partially encompassing or enclosing nozzle 34 so as to prevent inadvertent damage to nozzle 34, to enhance the appearance of housing 12, and to firmly hold cartridge 22 within interior space 20 as desired.

Upper housing portion 14 and lower housing portion 16 are preferably slidably mounted together, as set forth above. As shown in FIG. 1, a slot and stop structure 46 may also be provided so as to limit a maximum separation movement of upper housing portion 14 relative to lower housing portion 16. As shown in FIG. 1, a slot 48 may suitably be provided in lower housing portion 16, and a stop 50 positioned at a lower portion of side wall 18 of upper housing portion 14 and slidably disposed within slot 48. Upper end 52 of slot 48 serves to engage stop 50 at a maximum "open" position of upper housing portion 14 relative to lower housing portion 16.

Slot 48 may preferably be provided in lower housing portion 14 as a slot passing through the entire thickness of the side wall of lower housing portion 16 such that stop 50 is visible exterior of housing 12. This advantageously allows stop 50 to serve as a "use-up" indicator to a consumer, thereby indicating when cartridge 22 is nearly exhausted of product.

For additional stability, lower housing portion 16 may advantageously be provided with feet 54 or other base-widening structure so as to provide dispenser 10 with increased stability and reduced tendency to tip over.

It should be noted that dispenser 10 may be provided either already including a cartridge 22, or with cartridges 22 packaged separately. By packaging cartridges 22 separately, housing 12 for dispenser 10 could be packaged and shipped in a completely "closed" position of upper housing portion 14 relative to lower housing portion 16, thereby providing a significant savings in package sizing which is not possible with dispensers such as those of U.S. Pat. No. 5,289,949.

To insert a cartridge 22 for use, a consumer would slide upper housing portion 14 relative to lower housing portion 16 toward a completely "open" position, for example as illustrated in FIG. 2, so as to expose cutout 40 and thereby allow access to interior space 20. Cartridge 22 is then readily positioned within interior space 20, with nozzle 34 extending outwardly through cutout 42, and is now fixedly mounted within upper housing portion 14. Downward displacement of upper housing portion 14 relative to lower housing portion 16 as shown by arrow A (FIG. 2) serves to downwardly displace cartridge 22 relative to ram structure 24 of lower housing portion 16, upwardly biasing plungers 30 within chambers 28 to force product portions or components out of outlets 36 and into nozzle 34 of outlet structure 32, typically in a non-mixed side-by-side relationship as desired. Product from within cartridge 22 is used in increments by a consumer until the product supply of cartridge 22 is completely exhausted, at which time cartridge 22 can easily be replaced by upwardly sliding upper housing portion 14 relative to lower housing portion 16 back toward the position of FIG. 2 so as to again expose cutout 40 and allow access to interior space 20 for removal of a spent cartridge 22 and installation of a new cartridge in its place.

It should readily be appreciated that in accordance with the present invention, a significantly reduced portion of the overall dispenser or container is now discarded with each refill, thereby providing the opportunity for supplying the consumer with product at a reduced cost.

Cartridge 22 may advantageously be provided with a ridge structure 56 arranged along at least a portion of the side edges of cartridge 22 as shown.

Ridge structure 56 serves advantageously to provide structure for gripping cartridge 22 thereby facilitating installation and removal of cartridge 22 relative to upper housing portion 14. In this regard, ridges 56 are preferably positioned so as to be exposed through cutout 18 when cartridge 22 is installed within interior space 20.

Figure 5:
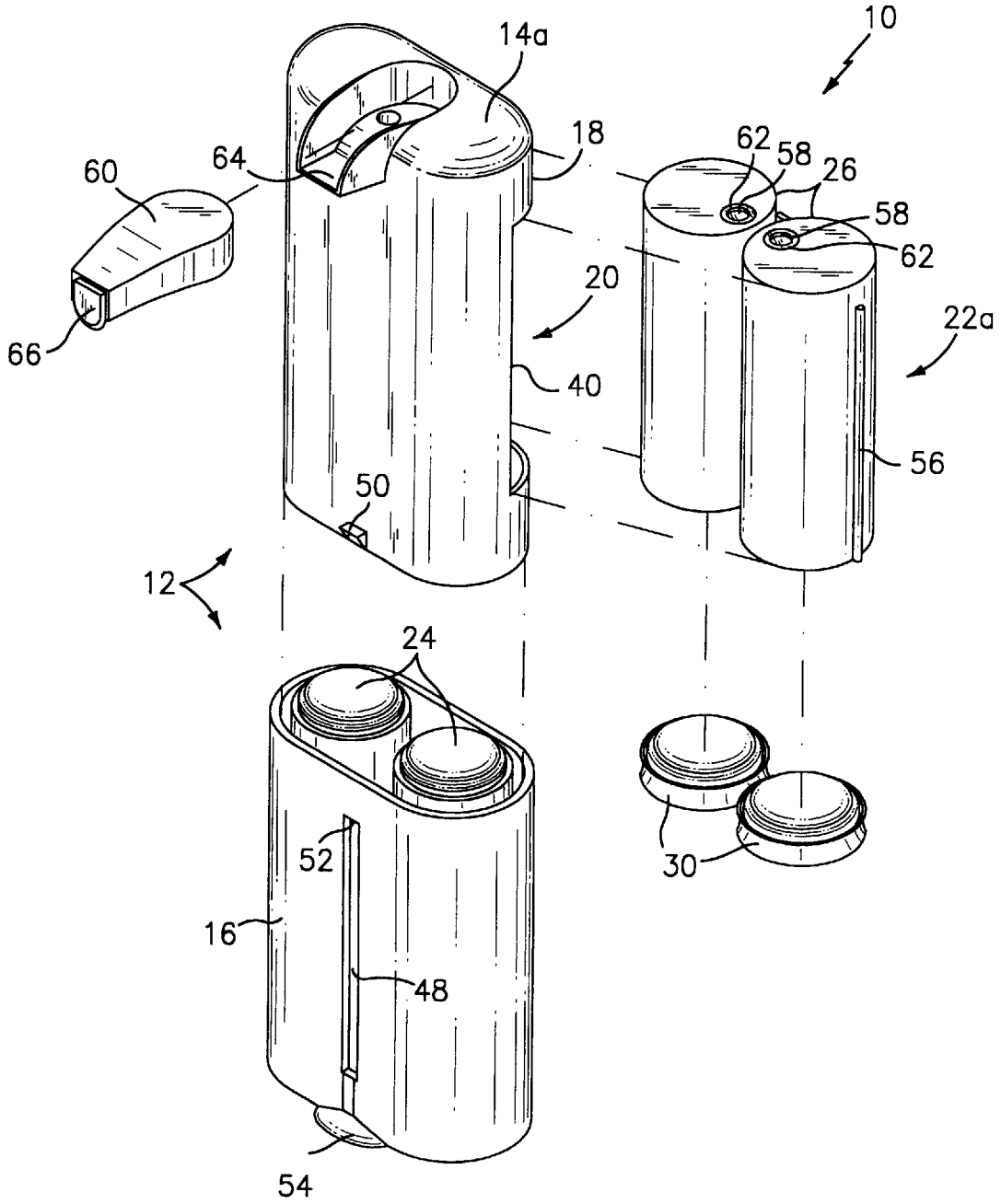
FIG. 5 is an exploded perspective view of an alternative embodiment of the present invention.

Referring now to FIG. 5, an alternative embodiment of the invention is illustrated.

FIG. 5 shows housing 12 having upper housing portion 14*a* and lower housing portion 16, as well as cartridge 22*a* for insertion through cutout 40 in interior space 20 as described above. In this embodiment, cartridge 22*a* is provided having a discrete outlet 56 from each chamber 28, and outlet structure 32 is provided in the form of a nozzle 60 mounted to upper housing portion 14*a*. In this embodiment, nozzle 60 may be provided with a manifold structure (not shown) for communicating with each chamber outlet 58 and combining same into a single outlet from nozzle 60. In further accordance with this alternative embodiment, each chamber outlet 58 may suitably be provided with a rupturable member 62 covering outlet 58 so as to seal product within chambers 28 until use is desired. Rupturable member 62 may be provided such that an initial use of dispenser 10 exerts sufficient pressure upon rupturable member 62 through product being compressed within chambers 28 by plungers 30 that rupturable member 62 ruptures so as to allow flow or extrusion of product into nozzle 60. Alternatively, a piercing structure (not shown) may be provided at an inlet portion of the manifold structure of nozzle 60 for piercing rupturable members 62 when cartridge 22*a* is installed within interior space 20.

Still referring to FIG. 5, upper housing portion 14*a* may suitably be provided with a shelf structure 64 defining a receptacle for nozzle 60 whereby nozzle 60 is advantageously held in place as desired.

The embodiment of FIG. 5 functions in all respects in the same manner as the embodiment discussed above in connection with FIGS. 1–4.

In the above embodiments, both nozzle 34 and nozzle 60 may advantageously be provided with a cap structure 66 for use in closing or sealing the interior portions of nozzle 34, 60 and chambers 28 between uses and/or for storage. Cap structure 66 may suitably be provided as a snap-fit cap for releasably engaging an outlet end of nozzle 34, 60, and may be provided attached to nozzle 34, 60 by a living hinge, or otherwise, or as a separate component.

It should be noted that although this disclosure is made in terms of a cartridge having two chambers 28 from which separate product portions or components are dispensed, the teachings of the present invention would be readily applicable to a cartridge having more than two chambers 28, if desired. This may be suitable, for example, for use in dispensing a product having three or more different components which are to be kept separate.

Furthermore, although the present disclosure is presented in terms of an extrudable toothpaste product having a sodium carbonate portion and a hydrogen peroxide portion, it should readily be appreciated that the product dispenser of the present invention could readily be applied to dispensing of other products having components which are desired to be kept separate until use.

The various components of dispenser 10 may suitably be provided of injection molded or vacuum formed plastics such as polypropylene, polyethylene and the like. Of course, a number of other alternative materials and manufacturing methods could be used well within the scope of the present invention.

In accordance with the foregoing, it is readily apparent that a product dispenser has been provided having a separable refill cartridge in satisfaction of the above-stated objects of the present invention, and others. This product dispenser advantageously provides for an easily replaceable product cartridge, and a greater percentage of reusable materials in the overall dispenser package.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

We claim:

1. A product dispenser, comprising:

a cartridge containing a product;

a housing having a sidewall defining an interior space for receiving said cartridge;

access means formed in said sidewall for installing and removing said cartridge in said interior space; and means associated with said housing for dispensing said product from said cartridge, wherein said housing comprises a first sleeve portion and a second sleeve portion, said access means being defined in one of said first sleeve portion and said second sleeve portion, wherein said first sleeve portion and said second sleeve portion are axially slidably mounted together and axially slidable together to a loading position wherein said access means is exposed for insertion of said cartridge.

2. A dispenser according to claim 1, wherein said housing comprises a first housing portion and a second housing portion, said first housing portion being movably mounted to said second housing portion, and wherein said access means provides access to said interior space with said first portion movably mounted to said second portion.

3. A dispenser according to claim 2, wherein said means for dispensing is mounted to one of said first portion and said second portion and said cartridge in said interior space is fixed relative to the other of said first portion and said second portion whereby movement of said first portion relative to said second portion dispenses product from said cartridge.

4. A dispenser according to claim 1, wherein said first sleeve portion has a first sleeve sidewall defining said interior space, and wherein said access means comprises a cutout in said first sleeve sidewall.

5. A dispenser according to claim 4, wherein said second sleeve portion has a second sleeve sidewall sized so that one of said first and second sleeve portions is slidably received in the other of said first and second sleeve portions.

6. A dispenser according to claim 5, wherein said cartridge has a wall structure defining a product space, at least one product outlet communicated with said product space, and at least one piston positioned relative to said product space for dispensing product from said at least one product outlet.

7. A dispenser according to claim 6, wherein said second sleeve portion further comprises at least one ram positioned to align with said at least one piston of said cartridge in said interior space whereby movement of said first sleeve portion relative to said second sleeve portion results in movement of said cartridge relative to said at least one ram.

8. A dispenser according to claim 4, further comprising means for slidably engaging said first sleeve portion with said second sleeve portion.

9. A dispenser according to claim 8, wherein said means for engaging comprises a slot in one of said first and second sleeve portions and a stop on the other of said first and second sleeve portions, said stop being slidably received in said slot so as to define a maximum range of separation of said first and second sleeve portions.

10. A dispenser according to claim 1, wherein said cartridge comprises a wall structure defining a plurality of discrete product spaces, and further comprising an outlet communicated with said plurality of discrete product spaces for dispensing product from said plurality of discrete product spaces together.

11. A dispenser according to claim 10, wherein said outlet comprises a nozzle mounted to the housing for communicating with said plurality of discrete product spaces of said cartridge in said interior space.

12. A dispenser according to claim 10, wherein said outlet comprises a nozzle on said cartridge and communicated with each of said plurality of discrete product spaces, said nozzle extending from said housing when said cartridge is in said interior space.

13. A dispenser according to claim 12, wherein said housing further comprises nozzle receiving means for allowing said nozzle receiving means for allowing said nozzle to extend from said housing.

14. A dispenser according to claim 13, further comprising a shroud member on said housing for at least partially covering said nozzle.

15. A dispenser according to claim 12, further comprising a cap member associated with said nozzle for covering and uncovering said nozzle.

16. A dispenser according to claim 10, further comprising a rupturable member positioned between said plurality of discrete product spaces and said outlet whereby product in said discrete product spaces is isolated until product is dispensed from said cartridge.

17. A dispenser according to claim 16, wherein an initial use of said means for dispensing ruptures said rupturable member to allow product to be dispensed together from said plurality of discrete product spaces.

18. A product dispenser, comprising:

a cartridge containing a product;

a housing having a sidewall defining an interior space for removably receiving said cartridge;

said cartridge having a wall structure defining a plurality of discrete product spaces, and an outlet communicated with said plurality of product spaces for dispensing said product, said outlet being connected to said cartridge and extending from said housing when said cartridge is in said interior space; and means associated with the housing for dispensing said product from said cartridge through said outlet, wherein said outlet is an extension of said cartridge.

19. A dispenser according to claim 18, wherein said outlet is one piece with said cartridge.

20. A dispenser according to claim 18, wherein said outlet comprises a nozzle connected to said cartridge, and wherein said housing has a nozzle cutout, said nozzle extending from said housing through said cutout when said cartridge is in said interior space.

21. A cartridge for a product dispenser, comprising:

cartridge wall structure defining a plurality of discrete product spaces each containing product;

an outlet extending from said cartridge and communicated with each of said cartridge and communicated with each of said plurality of discrete product spaces; and a piston member slidably positioned in each of said plurality of discrete product spaces for driving product from said discrete product spaces out of said outlet, wherein said outlet is an extension of said cartridge wall structure.

22. A cartridge according to claim 21, wherein said outlet is one piece with said cartridge wall structure.

23. A cartridge according to claim 21, further comprising a cap member replaceably mounted to said outlet for selectively covering and uncovering said outlet.

24. A cartridge according to claim 21, wherein said cartridge has first and second discrete product spaces, and further comprising a first product portion in said first product space with a second product portion in said second product space, and wherein said first product portion and said second product portion are dispensed together through said outlet.

* * * * *